United States Patent [19]

Fletcher

[11] Patent Number: 4,946,586

[45] Date of Patent: Aug. 7, 1990

[54] GRAVITATIONAL SEPARATION

[76] Inventor: John M. Fletcher, 373 Norwood Rd., London SE27 9BL, England

[21] Appl. No.: 70,810

[22] Filed: Jul. 7, 1987

[30] Foreign Application Priority Data

Jul. 9, 1986 [ZA] South Africa ..... 86/5107

[51] Int. Cl.[5] ..... B03B 5/02

[52] U.S. Cl. ..... 209/435; 209/438; 209/441; 209/443; 209/503; 209/506

[58] Field of Search ..... 209/435, 436, 437, 438, 209/439, 503, 504, 505, 506, 485, 441, 443

[56] References Cited

U.S. PATENT DOCUMENTS

| | | | |
|---|---|---|---|
| 641,720 | 1/1900 | Murphy | 209/441 |
| 953,520 | 3/1910 | Dykes | 209/437 |
| 1,273,946 | 7/1918 | Standley | 209/441 |
| 2,097,422 | 10/1937 | Rathjens | 209/437 |
| 2,256,504 | 9/1941 | Stewart | 209/437 |
| 2,582,302 | 1/1952 | Weber | 209/441 |
| 2,989,184 | 6/1961 | Gobatti | 209/437 |
| 3,507,390 | 4/1970 | Mozley | 209/437 |
| 3,724,661 | 4/1973 | Gobatti | 209/504 X |
| 4,078,996 | 3/1978 | Cohen-Alloro et al. | 209/504 X |
| 4,253,943 | 3/1981 | Thrasher | 209/437 X |

FOREIGN PATENT DOCUMENTS

| | | | |
|---|---|---|---|
| 296959 | 1/1916 | Fed. Rep. of Germany | 209/435 |
| 3150995 | 6/1983 | Fed. Rep. of Germany | 209/506 |

*Primary Examiner*—Donald T. Hajec

*Attorney, Agent, or Firm*—Sughrue, Mion, Zinn, Macpeak & Seas

[57] ABSTRACT

A shaking table for ore-dressing, having riffles on its deck, has circular orbital motion imposed on it to cause the riffles to oscillate, and for a standing wave to be created between the riffles. The continued circular motion acting on the standing waves causes sharp separation of the material fractions which are discharged continuously from the deck. The slope of the deck and riffles and the configuration of the riffles are critical. The slope of the deck is set empirically by estimating the approximate slope appropriate to the parameters of the material being treated and of the motion imparted to the deck; and the final adjustment is made by slewing the deck in its own plane to obtain an optimum result. For a frusto-conical deck, the adjustment is made on a flat deck and the frusto-conical deck is constructed accordingly. The deck may have rectilinear or curvilinear motion imparted to it, superimposed upon the circular motion.

12 Claims, 9 Drawing Sheets

GRAVITATIONAL SEPARATION

FIELD OF THE INVENTION

This invention relates to the dressing of ores and other particulate material by means of shaking tables.

BACKGROUND OF THE INVENTION

Known shaking tables consist of sloped deck, or the upper bight of a moving belt, with or without superficial riffles and with means to vibrate the deck. The collective effect of deck motion, deck slope, deck surface, riffle configuration, rates of flow of material and wash medium, deck geometry and interaction of the material being treated with the wash medium, combine to achieve separation of the material into its components. The behaviour of such tables is in practice unpredictable owing to the inability to alter the variable parameters individually to meet the process conditions.

As a result, all shaking tables in current use that are known to the applicant are necessarily a compromise. Where deck motions imposed by linear vibration generate discontinuous shear forces, by the very nature of asymmetric or reciprocal motion, particle deceleration and remixing of the separated fractions occur. Where shaking is caused by rotation of an out-of-balance shaft, an unpredictable elliptical path is imposed on the particles traversing the deck and there is a control problem where the frequency of the oscillatory motion approaches the natural frequency of the table supports. In the latter case, the rate of shear is a function of at least three variables, viz rotational speed, amplitude and total shaken weight.

Adjustments to deck pitch are limited to either longitudinal or transverse slope, or both, but do not compensate for change with pitch of the approach angle of the stream of material to the riffles.

As far as the applicant is aware, no method has been used which yields an operation under continuous discharge with discrete control of any single variable which influences the separation and concentration of materials containing fractions within the range of densities.

OBJECT OF THE INVENTION

The object of this invention is to propose an operating method and a shaking table to carry out the method, which have advantages over conventional methods and tables.

THE INVENTION

According to the invention a method of treating ores of solid materials composed of a mixture of particulate components which have different physical characteristics, consists in flowing a stream of the material and of wash medium on to a riffled inclined deck creating a standing wave in the wash medium containing the material in the troughs between the riffles, while imposing continuous planar circular motion on the standing wave; and thereby causing the components of the mixture to separate from one another into fractions, and the mobile fractions; and continuously discharging the fractions from the deck.

By "planar" is meant that the deck is moved along a prescribed path, and that the path lies within a plane irrespetive of the configuration of the deck or of the angular relationship between its axis and the plane.

The circular motion imparted to the deck imposes continuous, circular, oscillatory motion on the riffles.

Also according to the invention, for a flat deck, the method includes adjusting the tilt of the riffled deck about its longitudinal and lateral axes and while maintaining the deck in that attitude, slewing it in its own plane about an axis normal to the deck surface through an arc of up to 60 degrees; and continuously discharging the mobile fractions from the deck.

The method of the invention has the important distinction compared with known shaking tables in that the discharge of discrete mobile fractions is continuous and not discontinuous nor batch-wise.

Further according to the invention, the inclination of the riffles is less than the inclination of the natural direction of stream flow, and the angle between the two in the plane of the deck is acute throughout the motion of the deck. By Cartesian convention, taking the riffles as the X axis, the acute angle lies in the second quadrant for clockwise motion of the deck and the first quadrant for anti-clockwise motion of the deck respectively, when the deck surface is subjected to circular motion.

Further according to the invention, the acute angle of attack of the fluent stream to the riffles is adjusted by means of slewing the deck in its own plane about an axis normal to the deck surface through an arc of up to 60 degrees and thereafter, imposing oscillating, circular motion on the riffles.

Further according to the invention, the method consists in imposing differential trochoidal motion on a stream of fluent material subjected to horizontal shear forces to cause a divergent longitudinal advance of mobile fractions of the material along the deck dependent upon physical characteristics of the particles and the continuous discharge of sharp fractions from the deck.

In one form of the invention, linear motion, rectilinear or curvilinear, is superimosed upon the circular motion of the deck.

THE DRAWINGS

Embodiments of the invention are shown in the accompanying drawings, in which.

DESCRIPTION OF THE ILLUSTRATED EMBODIMENTS

Figure 1:
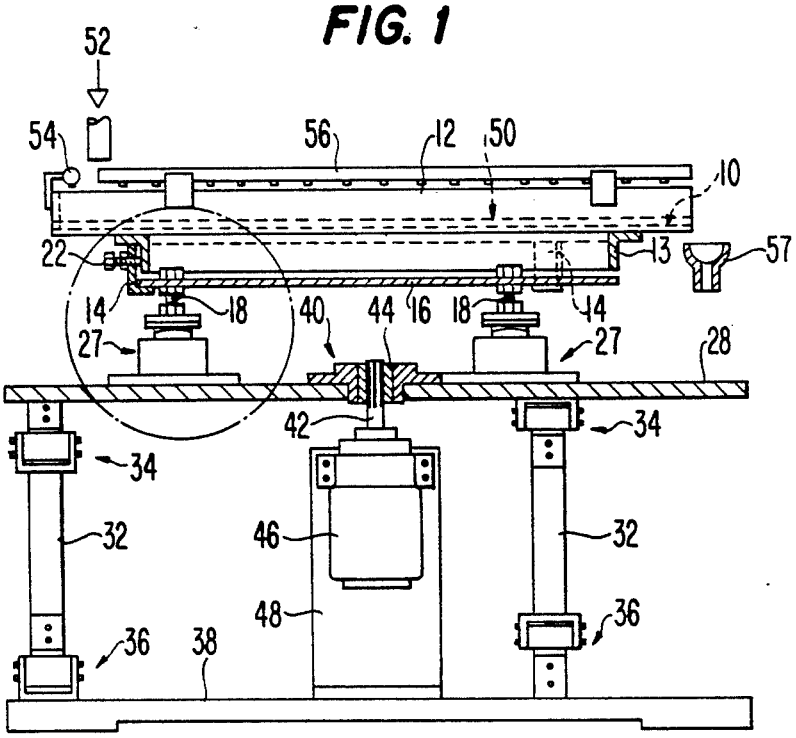
FIG. 1 is a side elevation, partially sectioned, of the shaking table of the invention.
Figure 2:
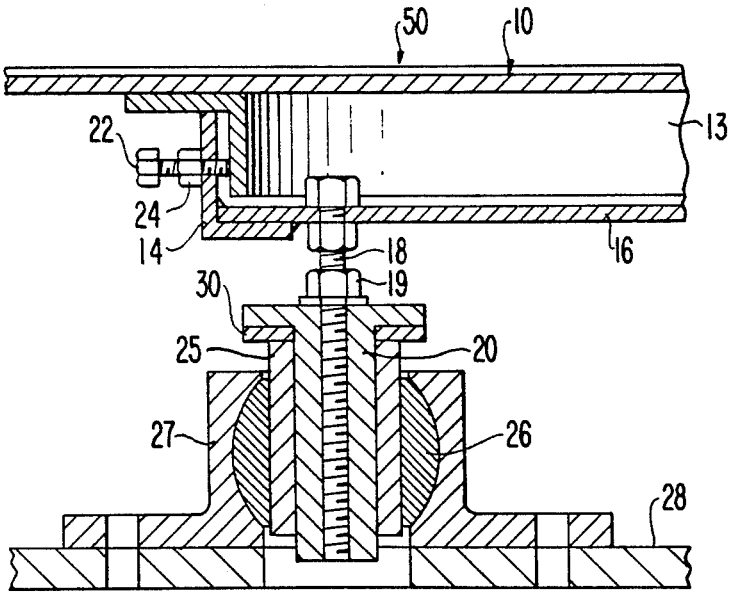
FIG. 2 is an enlarged fragmentary side elevation of the tilt and slew mechanism, indicated by the chain line circle in FIG. 1.
Figure 3:
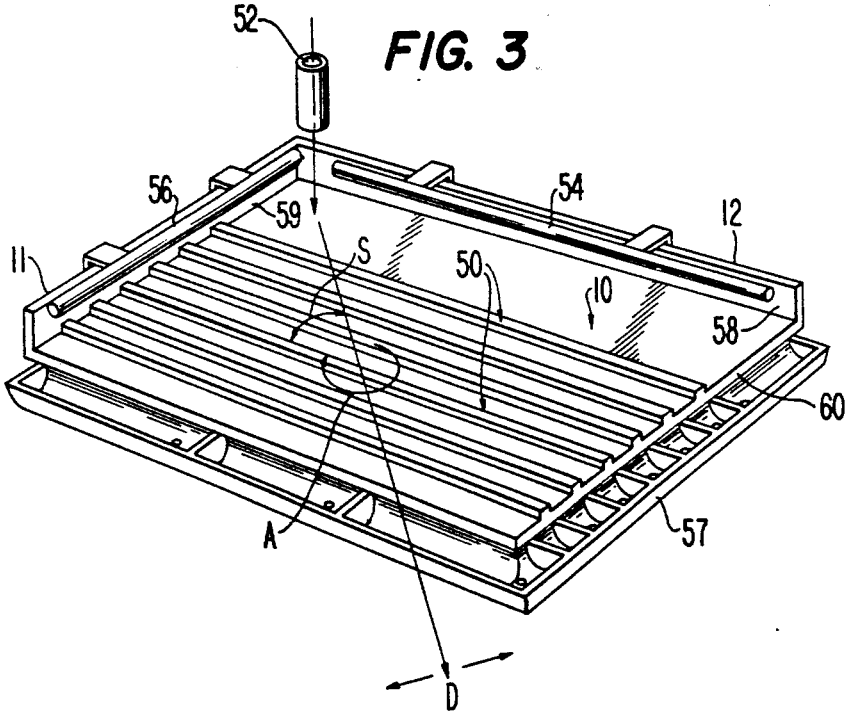
FIG. 3 is a perspective view of a portion of the deck.

The shaking table illustrated in FIGS. 1 and 2 comprises a flat, tilted deck 10 with side walls 11 and 12 (FIG. 3). The deck is mounted on a carrier ring 13, which rests on three equidistant vertical slide plates 14. The slide plates are mounted on a rigid bearer frame 16.

The frame 16 is carried by three vertical jacking bolts 18 equally spaced apart, as is more clearly seen in FIG. 2, and each provided with a lock nut 19 and a spring washer 21 and let into a screw-threaded and shouldered shaft 20.

Each slide plate 14 is horizontally tapped to receive a locking screw 22 and a lock nut 24. The shaft 20 is contained within a sleeve 25 of a self-aligning flanged bearing, which is mounted on a motion-distributor plate 28. Spacing washers 30 are fitted between the bearing sleeve 25 and the underside of the shoulder of the shaft 20.

The sleeve 25 is arranged within a spherical bearing 26 to enable the sleeve to rotate, and which enables the jacking bolts to swivel in their housings 27.

The spacing washers 30 are supplied in varying thicknesses in order to return the travel of the shaft screw-threading to within range of the jacking bolts 18. The slope of the deck is adjusted by rotating the shouldered shaft 20 inside the bearings 26 to vary the effective length of the bolts and thus to vary the tilt of the deck in three dimensions. During this adjustment, one of the bolts 18 is left at constant height.

The orientation of the deck and carrier ring is held on the tilting bearer frame 16 by the locking bolts 22 and nuts 24 which, when slackened, permit the deck and carrier ring slewing adjustment by rotation of the deck in the plane of the deck about an axis normal to the deck surface, independently of the tilting bearer frame.

The motion distributor plate 28 is connected to three or more (and preferably three) legs 32. Each set of legs has an elastic universal mounting 34 located at one end and another 36 at the other end. The upper universal mounting 34 is bolted to the motion distributor plate and the lower universal mounting 36 to a base frame 38.

The motion distributor plate 28 is connected centrally by means of a smooth self-aligning flanged bearing 40 to a motor drive shaft 42 which is releasably engaged with an eccenric bearing on bush 44.

A suitable variable speed controlled drive motor 46 is mounted on a rigid independent support 48 fixed to the base frame 38.

The motor 46 serves to rotate the drive shaft 42, and the eccentric bush 44 which is interchangeable to give the desired amplitude. The motion of the eccentric offset shaft follows a perimeter defined by a circle which is co-axial with respect to the motor drive shaft, giving a circular motion to the motion distributor plate 28. Thus, rotation of the drive shaft 42 will cause the motion distributor plate 28 at all points to orbit exactly in its own plane. This motion is transmitted to the deck 10 without yawing, pitching or heaving motion.

Figure 4:
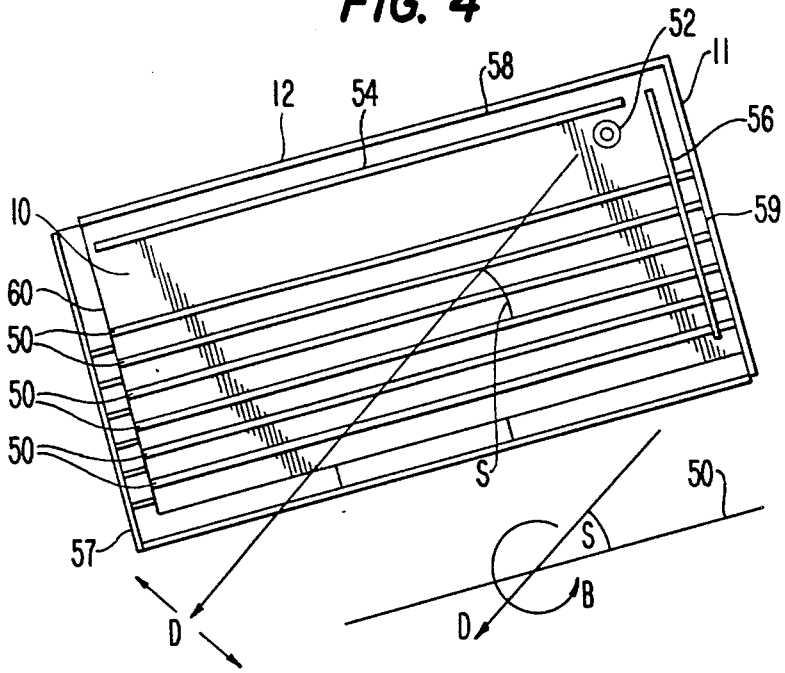
FIG. 4 is a plan view of a riffled deck orientated for anti-clockwise rotation.

The deck 10 (FIGS. 3 and 4) has a surface which carries raised riffles 50, served by a feed distributor 52 and peripherally fitted on adjacent sides with wash medium distributors 54 and 56, each having separate means of flow control (not shown) and a plurality of nozzles. One distributor 54 is mounted along the side 58 of the deck and the other distributor 56 along the upstream side 59 of the deck. A peripheral launder 57 which is transversely partitioned, is located under the remaining two side edges of the deck.

The method of the invention requires that, in operation, the deck 10 oscillate in its own plane. The spatial relationship of the plane to the horizontal and to the vertical, for optimum performance, is dependent upon the nature of the material being handled, and parameters such as amplitude and frequency of oscillation.

While it may be theoretically possible to arrive at the optimum relationship of the plane for any particular material, it would, in practice, be impossible. For that reason, the method of the invention provides that the table be adjusted empirically in relation to the horizontal and vertical, by a guesstimate. This having been made, the bolts 18 are adjusted in length to tilt the table accordingly. Samples of the material, together with the fluent wash medium are then fed on to the deck via the feed distributor 52 and the medium distributors 54 and 56, while the deck is oscillated. Adjustments of the deck orientation are made and variations of the other parameters—the rate of feed, the amplitude and frequency of oscillation—are tested, until sharp separation of the particles or other desired result is achieved, when the bolts 18 are locked permanently (as far as that material is concerned). In practice it has been found that optimum separation is readily determined by examination of the fractions discharged from the deck, so that the empirical phase for each material is short.

Figure 18A:
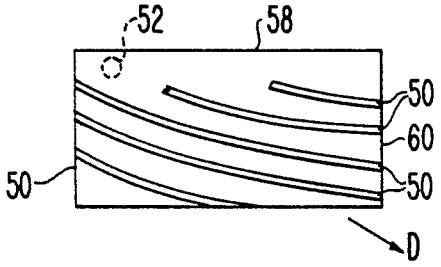
FIGS. 18A to 18D are plan views of riffle configurations.
Figure 18B:
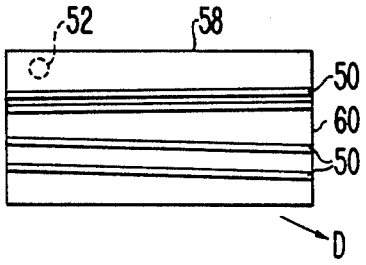
Figure 18C:
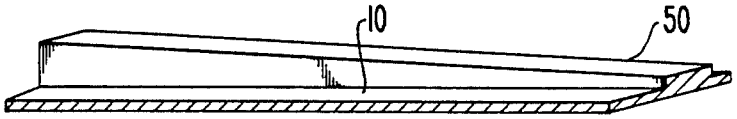
Figure 18D:
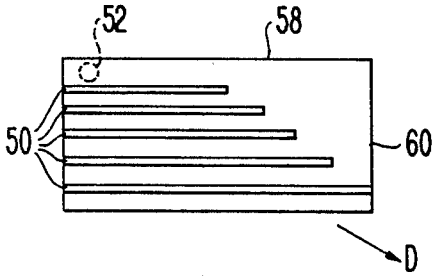

The riffles 50 (FIGS. 3 and 4) may be straight and parallel or arcuate and co-axial (FIG. 18A). They may be inclined to the edge 58 of the deck, or parallel to it (FIG. 18D). They may cover part only, or all of the surface of the deck. They may vary in pitch (FIG. 18B). They may diverge (FIG. 18B).

Figure 5:
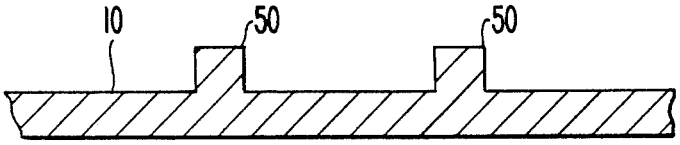
FIG. 5 is a fragmentary section side elevation of the riffles on the decks of FIGS. 3 and 4.

In cross-section, the riffles may be constant, that it rectangular (FIG. 5), or they may taper in their height (FIG. 18C) or their length (FIG. 18D).

The deck characteristics for second quadrant operation are illustrated graphically in FIG. 3. Here, the deck slope is marked D, the acute angle of fluid approach to the riffles in the second quadrant S, and the clockwise rotational movement of the deck A. The deck characteristics for first quadrant operation are illustrated graphically in FIG. 4 with appropriate anti-clockwise rotational movement B.

The applicant has established that the sense of rotational movement and slope of the deck with respect to the quadrant are significant.

After the optimum orientation of the deck and the various parameters of motion and feed have been established, the particulate material to be treated is flowed on to the deck at a high position through the feed distributor 52 together with the wash medium through distributors 54 and 56.

Figure 6:
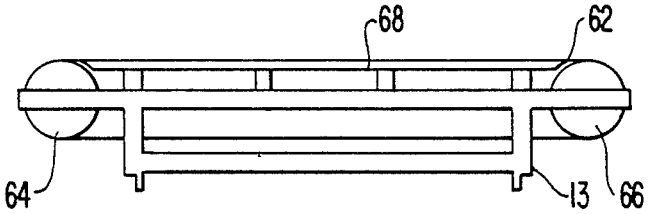
FIGS. 6 and 7 are respectively a side elevation and a plan view of a deck provided by a moving belt.
Figure 7:
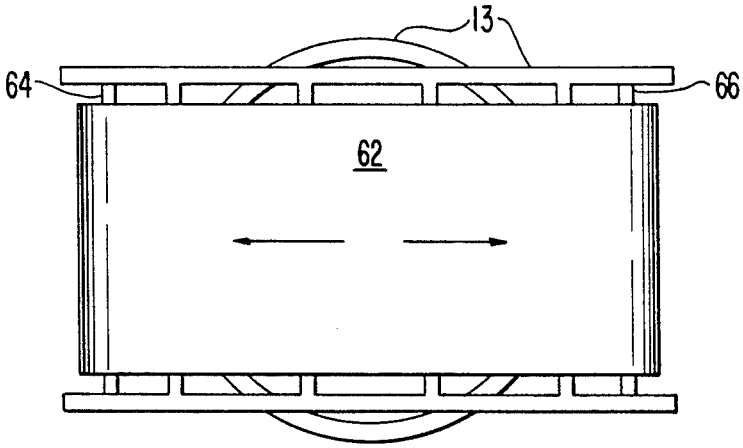

It will be appreciated that the table description is simplistic and that there may be multiple decks side by side, or stacked decks. Further, the deck surface (FIG. 6) may consist of the upper bight of a moving belt 62 which may move in either direction (FIG. 7) and where the belt is supported by the slide plate 68 fixed to the sub-frame integral with the carrier ring 13. One of the two conveyor rollers 64 and 66 is motorised with speed control.

Figure 8:
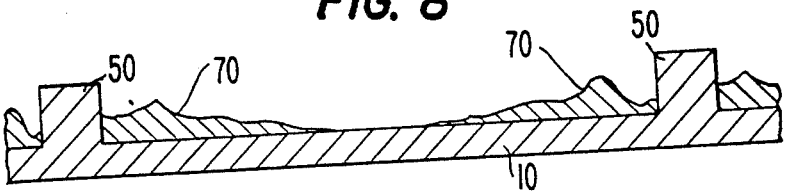
FIG. 8 is a fragmentary section side elevation of a deck showing schematically a progressive wave in decay.

The configuration of the individual riffles is such that the hydraulic progressive wave is created on both sides of the riffle as a result of the oscillatory, circular motion imposed on the riffles 50. Beyond particular riffle pitch, deck and riffle slopes, and within a particular rotational speed, amplitude or riffle height, the progressive wave 70 decays before reaching the uppermost of two adjacent riffles 50 (FIG. 8). Even under these conditions the mechanism of separation is effective.

Figure 10A:
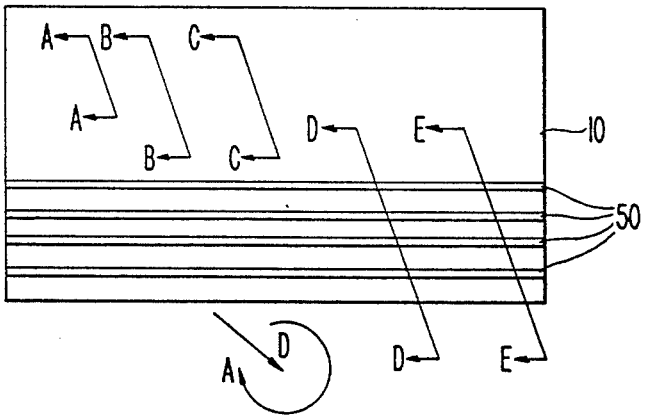
FIGS. 10A to 10H show schematic views of the behaviour of particles.
Figure 10B:
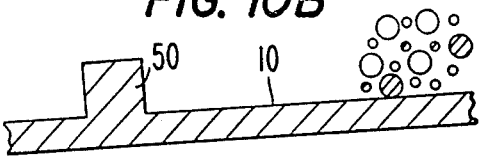
Figure 10C:
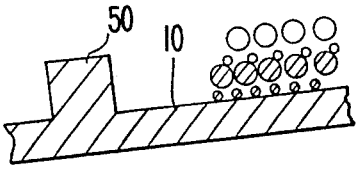

FIG. 10A is a plan view of a deck 10 with parallel ridges 50. The figure includes section lines A—A to E—E to show the position of the particles at various locations across the deck.

The behaviour of the particles as they traverse the deck solely by primary circular motion is shown in FIGS. 10B to 10H.

At section A—A (FIG. 10B), the material is arriving on the deck and the mixture of particles is random. The heavier particles are shown hatched while the lighter are shown in outline.

At section B—B (FIG. 10C), stratification and sorting resulting from the primary motion is shown. The particles have formed a dilated bed under stable levitation, with the heavier particles below the light and the particles of greater diameter above the fines.

Figure 10D:
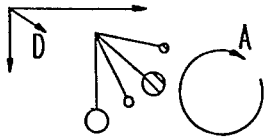

FIG. 10D is a plan view, at section C—C to indicate the net displacement with time of various strata in the plane of the deck.

Figure 10E:
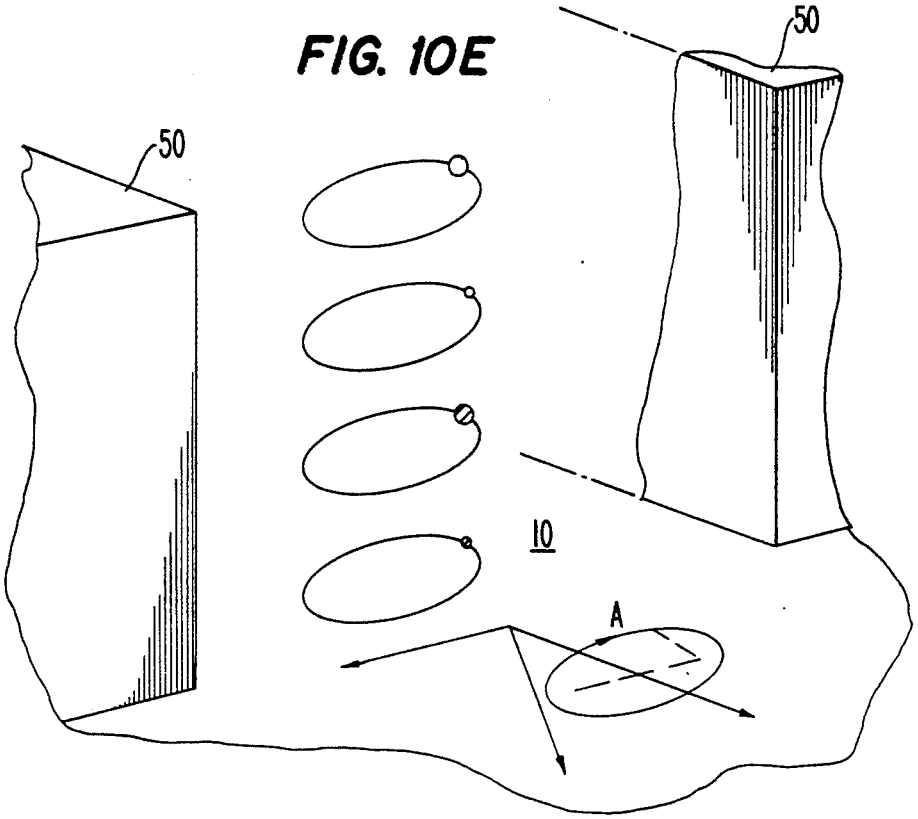

FIG. 10E is a spatial illustration of the orbital path A followed on the plane of the deck at different amplitudes by various strata in stable levitation.

Figure 10F:
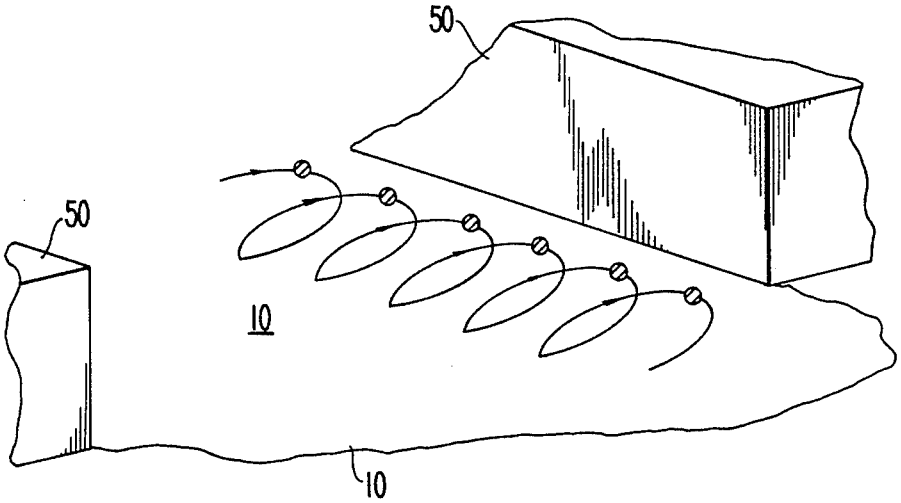

FIG. 10F is a section at D—D of the trochoidal path of progression in the plane of the deck followed by particles above a riffle under the influence of dynamic friction forces.

Figure 10G:
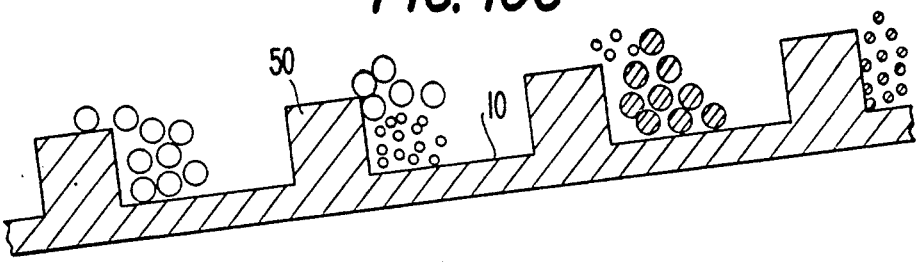

In FIG. 10G, at section D—D is shown a transitional condition of partially classified particles arranged above a series of riffles. It will be seen that classification is complete at the lowermost and uppermost riffles, and incomplete at the intermediate riffles. However, at those intermediate riffles, the heavier particles have descended below the lighter.

Figure 10H:
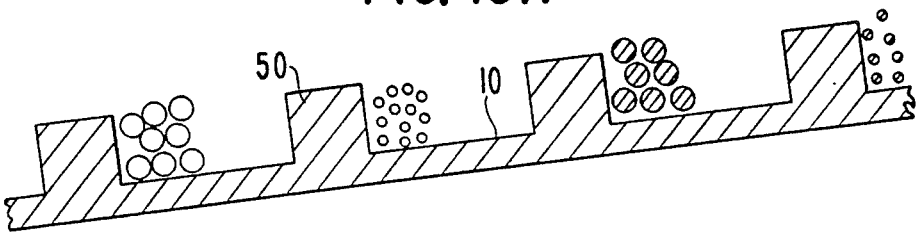

FIG. 10H is a section at E—E and shows the final condition of particles, sorted and classified above the riffles, prior to discharge from the deck.

Figure 9:
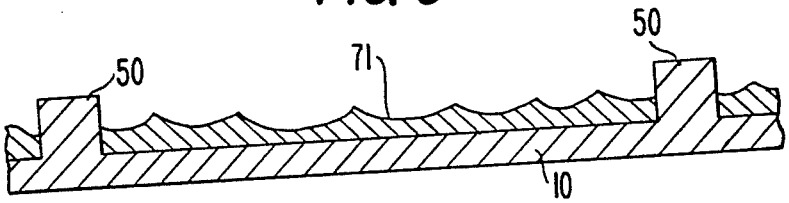
FIG. 9 is a view similar to that of FIG. 8, showing schematically a standing wave.

An analysis of the particle behaviour indicates that, by reducing independently the riffle pitch or either the deck or riffle slope, or by increasing either the amplitude or frequency of motion, or the riffle height, the hydraulic motion is compounded of two waves 70 progressing in opposite directions. The oscillatory, circular motion of the riffles causes an effect similar to vanning, and a series of standing waves 71 forms intermediate to and parallel to adjacent riffles as shown in FIG. 9.

With each standing wave nodes of instantaneous zero motion occur indigenous to a mean position with respect to the adjacent riffles. Nodal and antinodal zones are imposed upon by rotary shear forces. The particles entrained in a nodal zone are influenced by rotary shear forces. While this zone receives feed from upstream, lighter/larger particles in this zone are preferentially displaced by heavier/smaller particles until the inherent lateral transport capacity of each standing wave or riffle is occupied preferentially by relatively heavier/smaller particles. Particles between nodes execute simple harmonic motion. While the particles are encountering antinodal zones of maximum wave motion and surmounting the riffles, successive sorting occurs by the subsequent removal of successively lighter/larger particles.

Prior to and subsequent to the formation of standing waves, particles move down the deck by the mechanisms of surface washing and differential trochoidal displacement and the lateral, sliding migration of particles in contact or semi-contact with the deck surface intermediate the riffles, along the deck towards the deck perimeter 60 over which they spill into the partitioned launder 57.

When they reach the edge 60 (FIGS. 3 and 4) the particles have been classified into fractions, the concentrates being discharged at a higher level than the tailings and the middlings in between. It is a feature of the process that the separation of the fractions is sharp.

Figure 12:
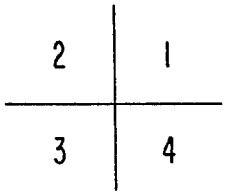
FIG. 12 is a representation of the quadrants of the deck according to Cartesian convention.
Figure 11:
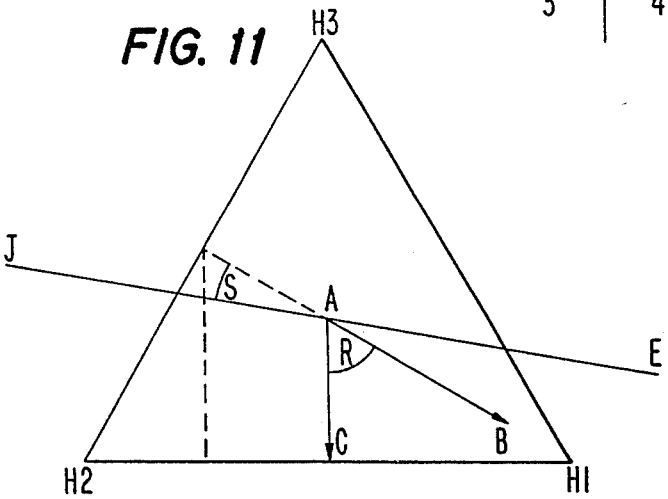
FIG. 11 is a plan view of slope geometry.

The performance of a riffled deck is controlled by slope as illustrated in FIGS. 11 and 12 and explained as follows: Consider two superimposed equilateral triangles separated tripodally by adjustable legs the heights of which are H1, H2, H3, respectively. While the lower triangle remains in the horizontal, always leaving H1=0, the pitch of the upper triangle may be altered by separate adjustments to H2 or H3. For purposes of illustration, assume that H3 will be always greater than or equal to H2 and that for clockwise circular motion fluid enters the diagram appropriately in the second quadrant at point A. For any value of H3 and where H2=H3 fluid will flow orthogonal to H2–H3 i.e. parallel to and along AB.

In the other case, for any value of H3, when H2=H1=0 then fluid will flow orthogonal to H1–H2 i.e. parallel to and along AC. By inspection, the maximum angular change R in the direction of fluid flow will be 60 degrees or less.

In order to maintain a given acute angle of attack S of fluid flow to any riffle, indicated by JAE, the maximum required operating range of rotational compensation of the line JAE about the point A will be 60 degrees or less taken in the plane of the deck.

For trigonometric reasons, as H2 is varied between H3 and 0 there is for any particular value of H3 relative to H1=0 and any particular angle of attack, a fixed ratio between riffle slope and natural fluid slope.

Figure 13:
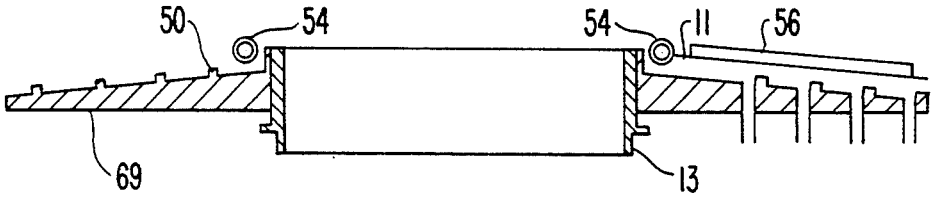
FIG. 13 is a side elevation of a frusto-conical deck.
Figure 14:
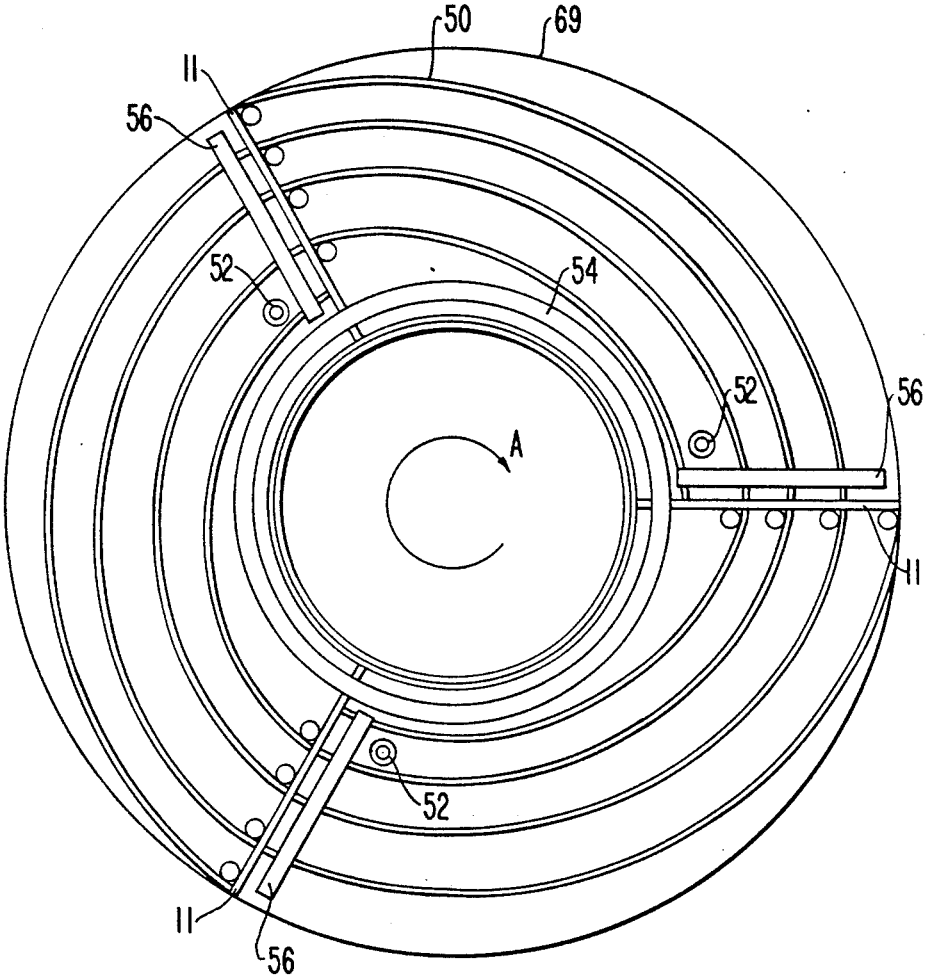
FIG. 14 is a plan view of the deck of FIG. 13.

Since the riffle slope is altered by slewing or rotating the deck the use of a partitioned frusto-conical surface (FIGS. 13 and 14) requires the riffle slope to be predetermined and the tripodal means to be equally adjusted to the horizontal. The term frusto-conical is intended to include the surface of a true frusto-cone as well as one on which the surface is convex or concave.

It will also be appreciated that the operation of the table is dependent upon the characteristics of the material being sorted. The establishment of the parameters of deck tilt, riffle slope, acute angle of attack, amplitude and frequency of oscillatory circular motion, rate of feed to the deck, rate of flow of the washing water, and so on are empirically determined, but the particular method of the invention allows the determination of optimum parameters to be established and reproduced with greater precision and accuracy than can be achieved by shaking tables in conventional practice. For example in the regimes of deck slopes of less than 2.5 degrees and of riffle slopes of less than 1.5 degrees, variable slope geometry as described above offers significant improvement in the control and performance of a riffled deck.

The following conclusions are based on test work using beach sand, and increasing independently the listed variables of circular motion.

Where
A=increases
B=increases and then falls
C=increases to a constant maximum
D=falls
E=remains constant
*=at constant 45 degree angle of attack, when riffle slope increases with deck slope
#=at constant deck slope.

| Variable | Product Grade | Riffle Transport Capacity |
|---|---|---|
| Feed Rate | C | E |
| Wash Rate | B | D |
| Deck Slope* | D | A |
| Riffle Slope# | B | D |
| Riffle Height | D | A |
| Rotational Speed | B | B |
| Amplitude | B | B |

Advantages may be achieved by imposing directional secondary linear (rectilinear or curvilinear) motion generally counter-current to the fluid flow on the deck, superimposed upon the primary orbital motion. The result of the combined motions is to enhance the efficiency of the separation and increase the transport capacity of the standing waves. The reason for this advantage is not fully understood but has been demonstrated in practice to be substantial. The means to do this is seen in FIGS. 15 and 16 where 72 shows a vibrator and 74 shows a second vibrator, arranged to cause mass transport generally counter-current, up-slope to fluid flow but insufficient to overcome trochoidal displacement.

Figure 15:
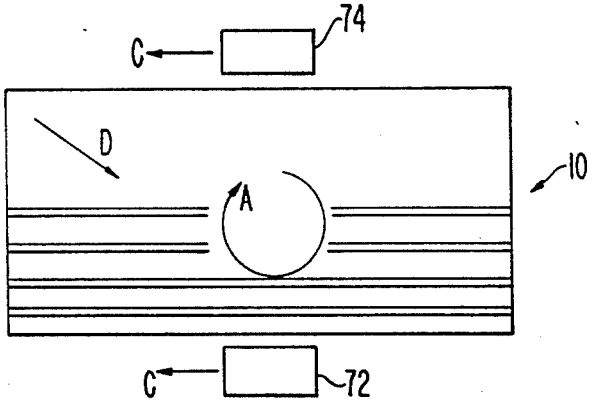
FIG. 15 is a schematic plan view of a deck arranged for rectilinear vibration.
Figure 16:
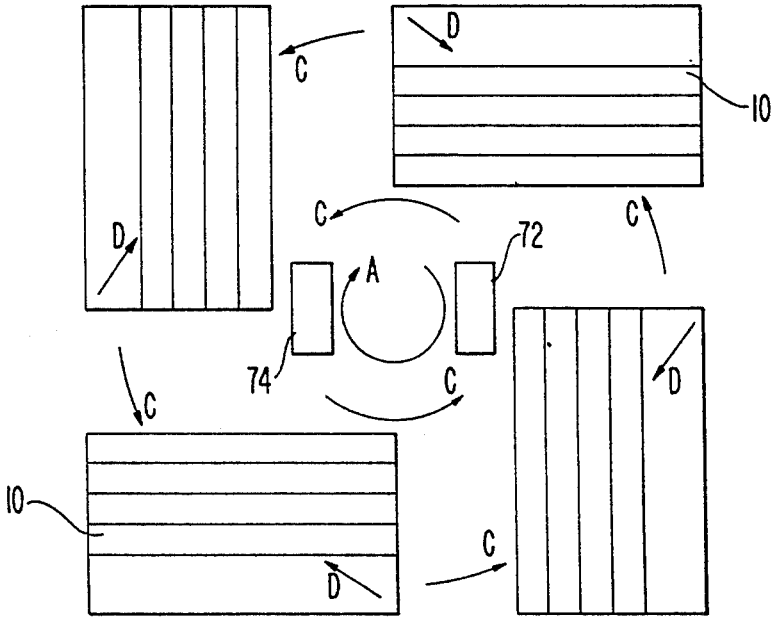
FIG. 16 is a schematic plan view of multiple decks arranged for curvilinear vibration; P

The advantages of variable slope geometry through slewing the deck are applicable to the operation of the table under linear motions as shown in FIGS. 15 and 16.

The driving means for linear motion comprises at least one pair of external vibrator motors, each having an adjustable working moment, and mass equally disposed radial to the central vertical axis of the table, motor axes inclined and adjusted in the vertical plane, and the shafts of which contra-rotate. The motor speeds are synchronised and controlled by regulating the frequency and voltage of three phase electrical power through an invertor. Rectilinear directional acceleration (FIG. 15) is achieved by disposing the axes of the vibrator motors 72 and 74 at a common angle to the horizontal plane, and curvilinear directional acceleration (FIG. 16) by disposing the axes of the vibrator motors 72 and 74 in apposition at an equal angle to the horizontal plane.

The amplitude of vibration is varied by adjustment to the working moment of the external vibrator motors.

The geometry of table construction and lay-out may require either rectilinear or curvilinear directional acceleration. In the latter case the effective deck surface must occupy the upper surface of a flat deck (FIG. 15) or be located entirely in one quadrant of a circle and outside the central vertical axis of the motor axes (FIG. 16), such that the lines of acceleration C are generally up-slope and counter to fluid flow D.

It is commonly known that with respect to the central vertical axis of curvilinear directional motion as generated by twin vibrators, the amplitude of motion remains constant with increasing radius, and for any frequency the acceleration of the particles increases radially by virtue of interference between the natural resonance of the apparatus and the vibrator motors.

The geometry of table construction and lay-out may require either rectilinear or curvilinear directional acceleration. In the latter case the effective deck surface must occupy the upper surface of a flat deck (FIG. 15) or be located entirely in one quadrant of a circle and outside the central vertical axis of the motor axes (FIG. 16), such that the lines of acceleration C are generally up-slope and counter to fluid flow D.

It is commonly known that with respect to the central vertical axis of curviliner directional motion as generated by twin vibrators, the amplitude of motion remains constant with increasing radius, and for any frequency the acceleration of the particles increases radially by virtue of interference between the natural resonance of the apparatus and the vibrator motors.

The apparatus described provides for one or two motions and particularly the amplitude of either the oscillatory, circular motion or the linear motion must be adjusted separately and independently; and the frequency of either motion must be steplessly and independently controlled.

As an alternative to external vibrators, polyeccentric fly-wheel type vibrators may be used to generate linear directional motion in the plane of the deck; and wherein the mass of the vibrators is counter-balanced with respect to the central vertical axis of the apparatus.

The rotational effects of out-of-balance shafts may be used to generate oscillatory, circular motion.

Whichever mode of motion or combination of linear and rotary motion, the advantages of slewing the deck remain and the separation of fractions is sharp.

As an example of the operation of the table, the following range of parameters has been found to be satisfactory:

primary motion: amplitude between 1 mm and 50 mm; rotational speed between 150 rpm and 300 rpm.

secondary motion: frequency between 1200 rpm and 1900 rpm.

Figure 17:
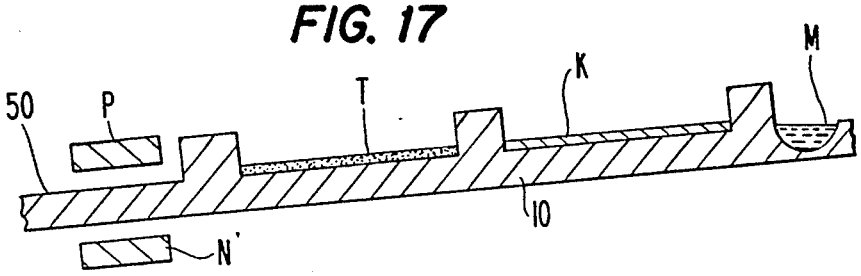
FIG. 17 is a schematic side elevation of a deck with means to amalgamate, trap hydrophobic constituents and separate electromagnetically shown in one figure for convenience of illustration.

While the method of the invention has been developed for the separation of particulate materials into fractions, the utility of the method goes further when certain fractions lose their mobility. As shown schematically in FIG. 17, the deck surface may be prepared by copper coating K or depressions M to receive mercury for the process of amalgamation; by using the table T as a grease table for trapping hydrophobic valuable constituents such as diamonds, or a mixture of such constituents and gangue; or by the facility of electro-magentic separation by mounting an electro-magnet P over, or one N, under the deck surface, with suitable non-magentic materials of constructions chosen for the apparatus.

I claim:

1. A method of treating material composed of a mixture of particulate components which have different physical characteristics: which consist in flowing a stream of the material and of a wash medium on to an inclined deck having riffles therein which define a plurality of troughs therebetween, and creating a standing wave in the wash medium containing said material in the troughs between the riffles while imposing continuous planar circular motion on the standing wave; and thereby causing the components of the mixture to separate from one another into fractions, and the continuously discharging the fractions from the deck.

2. A method of treating material composed of a mixture of particulate components which have different physical characteristics comprising: flowing a stream of the material and of a wash medium on to an inclined deck having riffles while imparting continuous, planar circular motion to the deck to impose oscillatory, circular motion on the riffles and thereby causing the components of the mixture to separate from one another into mobile fractions while causing the mobile fractions to remain discrete and continuously discharging the mobile fractions from the deck, tilting said deck about its longitudinal and lateral axes and, while maintaining said deck inclined, slewing it in its own plane about an axis normal to the deck through an arc of up to 60 degrees to vary the acute angle of approach by the stream of material to the riffles, fixing the deck in that orientation whereby during oscillatory, circular motion of the deck the riffles on the deck will oscillate at a constant acute angle relative to the natural direction of fluid flow.

3. The method of claim 2 in which the angle between the path of natural flow of the material over the deck and the orientated riffles is an acute constant angle throughout the motion of the deck.

4. The method of claim 2 in which the feed of material and wash medium is continuous.

5. The method of claim 2 in which the amplitude of circular motion is maintained constant over the deck with changes in frequency.

6. Apparatus for treating material composed of a mixture of particulate components which have different physical characteristics; consisting of a deck having riffles thereon, support means to support the deck, means to flow the material on to the deck, header means to flow a wash medium on to the deck, means to adjust the support means to vary the tilt of the deck about its longitudinal and lateral axes, means to slew the deck about an axis normal to the deck through an arc of up to 60 degrees, means to impose continuous planar circular motion on the deck in order to impose oscillatory, circular motion on the riffles, and means to maintain an acute angle between the natural path of flow of the material over the deck and the oriented riffles throughout the motion of the deck; means to secure the deck in adjusted position; and launders to receive separated mobile fractions of the treated material.

7. Apparatus as claimed in claim 6 wherein said support means is mounted on at least three legs which have an elastic universal mounting located at each end.

8. Apparatus as claimed in claim 6 in which the drive means for imposing oscillatory, circular motion on the riffles comprises a motion distributor plate integral with a smooth bearing connected via an off-set shaft rigidly supported, the support means being independent of the driven means.

9. Apparatus as claimed in claim 6 in which the deck surface is frusto-conical upwards and means is provided for slewing the deck.

10. Apparatus as claimed in claim 6 including the means to vary the frequency of oscillatory, circular motion at constant amplitude.

11. Apparatus as claimed in claim 6 including independent means to slew the deck together with said header means within an operational arc of up to 60 degrees in the plane of the deck about an axis normal to the plane of the deck surface.

12. Apparatus as claimed in claim 6 in which the deck support means comprises tripodal means for slope and tilt adjustment.

* * * * *